US006044161A

United States Patent [19]

Lee

[11] Patent Number: 6,044,161

[45] Date of Patent: Mar. 28, 2000

[54] PILLOW SPEAKER APPARATUS AND METHOD

[76] Inventor: Keith Lee, 114 156th St. East, Tacoma, Wash. 98444

[21] Appl. No.: 09/195,769

[22] Filed: Nov. 18, 1998

Related U.S. Application Data

[60] Provisional application No. 60/066,723, Nov. 21, 1997.

[51] Int. Cl.[7] ..... H04R 5/00

[52] U.S. Cl. ..... 381/301; 381/333; 381/388; 5/639; 5/904

[58] Field of Search ..... 381/301, 300, 381/87, 333, 332, 388, 386; 5/639, 904

[56] References Cited

U.S. PATENT DOCUMENTS

| | | | |
|---|---|---|---|
| D. 311,472 | 10/1990 | Giles . | |
| D. 327,802 | 7/1992 | Dowing . | |
| D. 338,798 | 8/1993 | Grzybinski . | |
| 3,290,450 | 12/1966 | Majoros | 381/301 |
| 3,621,155 | 11/1971 | Pruitt . | |
| 3,946,318 | 3/1976 | Hough . | |
| 4,038,499 | 7/1977 | Yeaple | 381/301 |
| 4,782,533 | 11/1988 | Haynie . | |
| 4,862,438 | 8/1989 | Fry . | |
| 5,123,132 | 6/1992 | Dixon . | |
| 5,123,133 | 6/1992 | Albert | 5/639 |
| 5,163,194 | 11/1992 | Dixon . | |
| 5,201,002 | 4/1993 | Dahlem . | |

*Primary Examiner*—Minsun Oh Harvey
*Attorney, Agent, or Firm*—William G. Forster

[57] ABSTRACT

The invention is a pillow speaker for use as a combination headrest and sound delivery system for transmitting sounds, including music to a person's head. The pillow speaker comprises a pillow headrest having an upper surface for receiving and supporting a person's head. Extending downward from the upper surface is a lower body portion. The lower body portion is adapted for support from an exterior stable surface, the pillow speaker being constructed from a homogeneous flexible material. A pair of spaced apart loud speakers are mounted through the upper surface, within the lower body portion. The loud speakers include an exterior face for projecting sound outward from the pillow speaker, and an opposing rear face for projecting sound into and through the lower body portion. Importantly, the lower body portion of the pillow speaker comprises a plurality of large voids through which sound waves from the loud speakers can travel upwardly through the upper surface thereby reaching the listener from many directions.

15 Claims, 3 Drawing Sheets

PILLOW SPEAKER APPARATUS AND METHOD

This application claims the benefit of U.S. Provisional Application Ser. No. 60/066,723 Filed Nov. 21, 1997.

BACKGROUND

The present invention relates generally to sound delivery and transmission systems, and more particularly to speaker sound systems installed in pillows provided for use as a headrest.

Pillow headrests having speakers incorporated therein are not new in the art. An early example of this combination is disclosed is U.S. Pat. No. 3,946,316 issued to Hough on Mar. 23, 1976. The '316 patent discloses a tubular flexible material divided into at least two segregated portions that define open-ended spaces wherein a radio and speakers are disposed therein to transmit sound waves and music. The Hough invention is somewhat complex in design and deviates substantially from the style, shape and arrangement of a common pillow used as a headrest.

In 1992, U.S. Pat. No. 5,123,133 issued to Albert disclosing an orthopedic pillow with speakers. The '133 patent includes a horizontally extending body for supporting the head of a user on upwardly extending cone-shaped members wherein downwardly extending leg members are disposed at opposing ends of the pillow body. The speakers therein are arranged to emit sound substantially upwardly, directly from the speakers to the user.

Other pillow headrests similarly constructed to the Albert Patent are U.S. Pat. Nos. 5,123,132 and 5,163,194 issued to Dixon in 1992. Although the '132 and '194 patents do not include means for transmission of sound and music, each is directed to similar pillow headrests that comprise upwardly extending cone-shaped members to support the user's head.

As noted above, pillow headrests that include speakers for sound transmission are known in the art. However no such speaker pillow device exists that utilizes the common construction and structure of a pillow to enhance the sounds directed to the listener. Accordingly, a need remains for a simple inexpensive pillow headrest that incorporates speakers, wherein the sound transmission thereof is enhanced by the structure of the pillow.

SUMMARY

One object of the present invention is to deliver and convey sounds and music to a listener while the listener is in a horizontal resting position with the head supported by a pillow device.

A second object of the invention is to enhance the quality of sound transmitted to a person disposed in the horizontal resting position.

Another object of the invention is to facilitate the portability of music to a listener.

Yet another object is to increase enjoyment of music by a listener while in the horizontal resting position.

A further object of the invention is to produce a therapeutic environment through transmission of music to a listener disposed in a resting position.

Still another object is to increase the efficiency of transmission of music to a listener.

The invention is a pillow speaker for use as a combination headrest and sound delivery and transmission system for delivering sounds, including music to a listener's head. The pillow speaker comprises a pillow headrest having an upper surface for receiving and supporting a person's head. Further, a lower body portion is also provided and extends downward from the upper surface. The lower body portion is adapted for support from an exterior stable surface, the pillow speaker being constructed from a homogeneous flexible material such as urethane foam.

In addition, a pair of spaced apart loud speakers are mounted through the upper surface, within the lower body portion. The loud speakers include an exterior face for projecting sound outward from the pillow speaker, and an opposing rear face for projecting sound into the lower body portion. Importantly, the lower body portion of the pillow speaker comprises a plurality of large voids through which sound waves from the loud speakers can travel, through out the lower body, and upwardly through the upper surface thereby reaching the listener from many directions.

The foregoing and other objects, features, and advantages of this invention will become more readily apparent from the following detailed description of a preferred embodiment which proceeds with reference to the accompanying drawings, wherein the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

DETAILED DESCRIPTION OF PREFERRED EMBODIMENT

Figure 1:
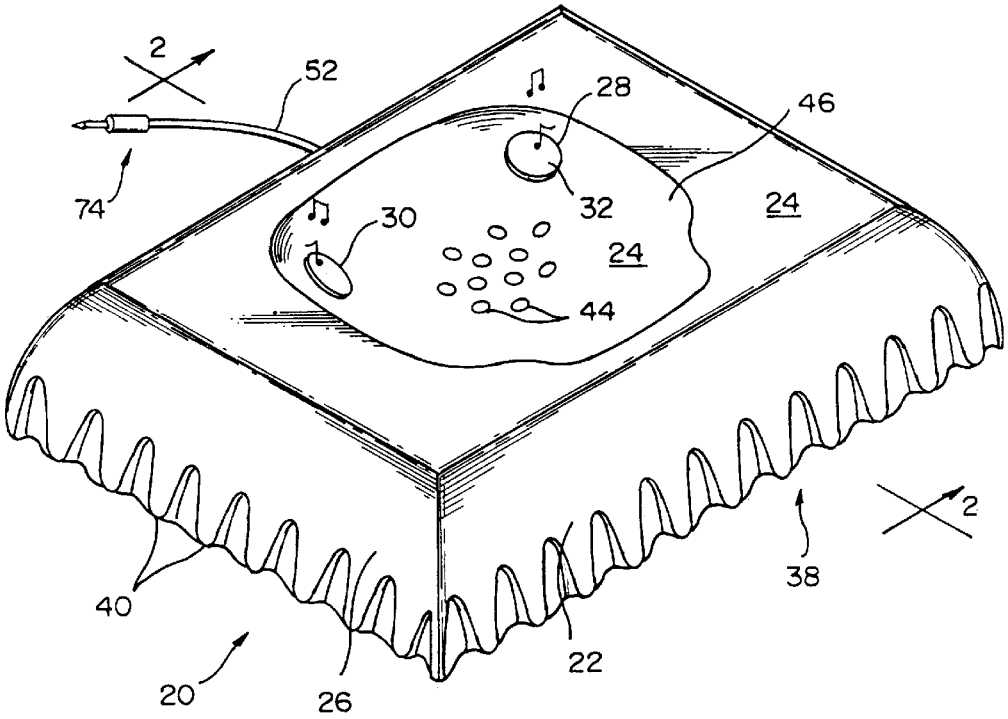
FIG. 1 is a front side perspective view of a preferred embodiment constructed in accordance with the present invention illustrating a pair of spaced speakers installed within the head receiving cavity into the pillow material.

FIGS. 1 through 5 illustrate a pillow speaker 20 constructed in accordance with the presentation invention. The pillow speaker 20 is provided for use as a combination headrest and sound delivery system for delivering sounds, including music to a person's head (not illustrated). Generally, the pillow speaker 20 comprises a pillow headrest 22 having an upper surface 24 for receiving and supporting a person's head. Opposing the upper surface 24 is a lower body portion 26 that extends downward from the upper surface 24. It should be understood that the lower body portion 26 is adapted for support from an exterior stable surface (not illustrated), and that the pillow headrest 22 is typically constructed from a homogeneous flexible material including foam products commonly employed in foam pillows including urethane foam products. One manufacturer of such products is the "Carpeting Company."

Figure 2:
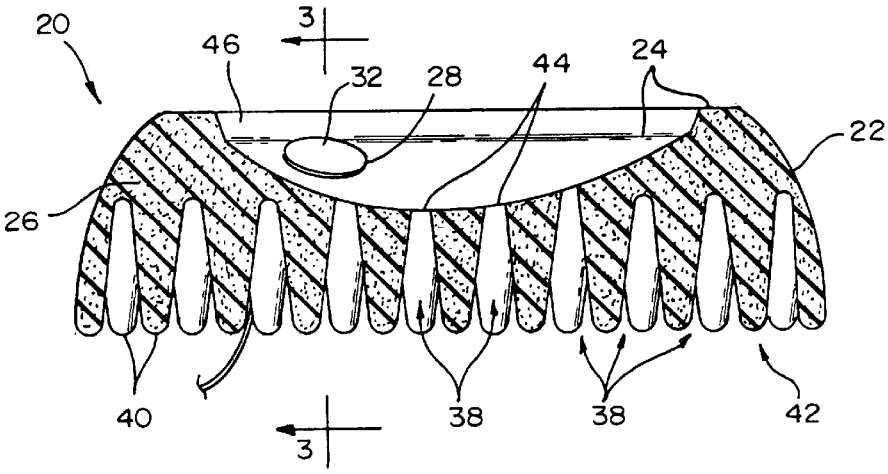
FIG. 2 is a cross sectional view taken along line 2—2 of a pillow speaker constructed in accordance with the present invention.
Figure 3:
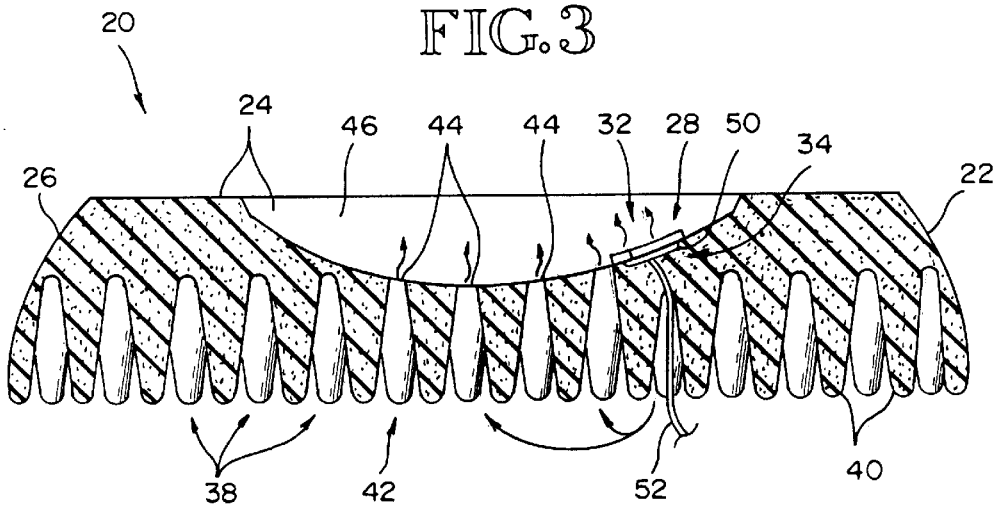
FIG. 3 is a cross sectional view taken along line 3—3 illustrating the position of a loud speaker mounted within a pillow speaker.
Figure 4:
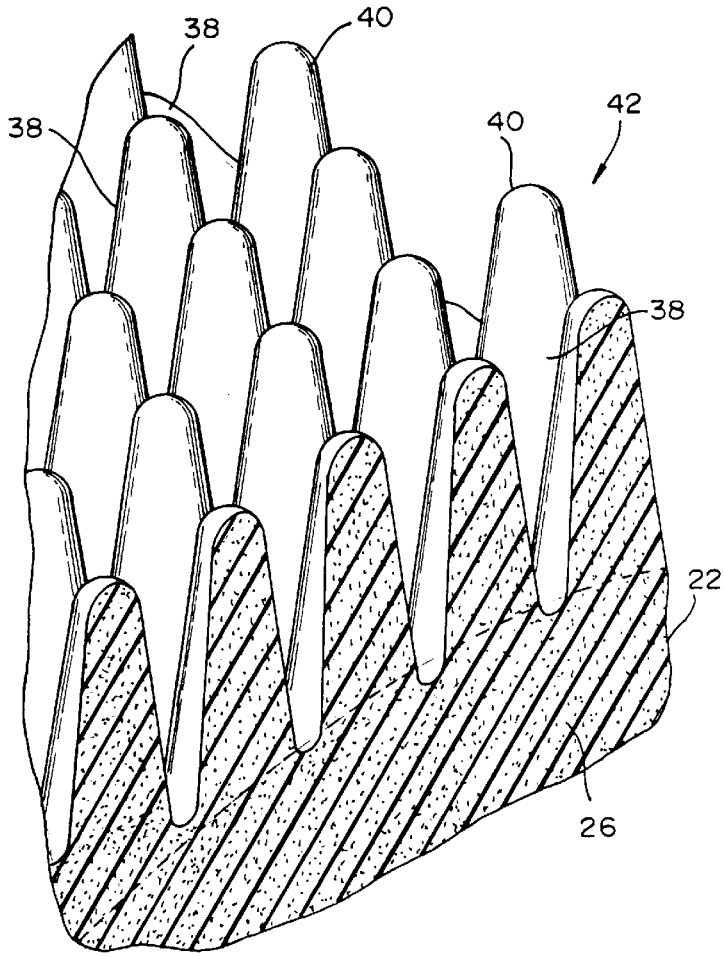
FIG. 4 is a fragmentary sectional view illustrating a plurality of sound baffles projecting from the pillow speaker.

Mounted within the pillow headrest 22 is a pair of spaced apart loud speakers 28 and 30. As best seen in FIGS. 1 through 3, the loud speakers 28–30 are mounted through the upper surface 24, within the lower body portion 26. In the preferred embodiment, the loud speakers 28–30 are identical in construction: each including an exterior face 32 for projecting sound outward from the pillow speaker 20, and an opposing rear face 34 for projecting sound into the lower body portion 26. Importantly, the lower body portion 26 of the pillow headrest 22 comprises a plurality of large interconnected, continuous sound channeling voids 38 through which sound waves from loud speakers 28–30 can travel.

Considering now in more detail the structure and components from which a pillow speaker 20 is constructed, the sound channeling voids 38, of pillow headrest 22 are arranged and provided to define a plurality of sound baffles 40. In the preferred embodiment, the sound baffles 40 are shaped in the form of cones 42 that extend outward, i.e., downward from the pillow speaker 20. To put it differently, a plurality of cones 42 project or cantilever outward with the cones 42 being arranged in a uniform symmetrical pattern. It should be understood that although the cones 42 are symmetrically disposed when the pillow speaker 20 is not in contact with a surface, the cones 42 deform when pressure is applied to the pillow speaker 20, against a supporting surface: for example when a user's head is resting upon the speaker pillow 20. Although such deformation takes place, sound channeling voids 38 are maintained to channel the sound throughout the pillow headrest 22. Further, although the preferred embodiment employs sound baffles 40 shaped in the form of cones 42, other shapes (not illustrated here) could be employed with equally satisfactory results.

As will be discussed more fully below, a plurality of sound communication openings 44 are provided through the upper surface 24 so that sounds, i.e., sound waves, can travel from the sound channeling voids 38 through the upper surface 24 thereby reaching the user's head. As a method of forming the sound communication openings 44, and as a feature of comfort, the upper surface 24 is formed to define a head receiving cavity 46. As best illustrated in FIG. 2, the head receiving cavity 46 extends downward toward the lower body portion 26 such that the sound communication openings 44 are naturally formed. To put it differently, a portion of the head receiving cavity 46 extends downward to the sound baffles such that the sound channeling voids 38 form the sound communication openings 44 for communication of sounds between the lower body portion 26 and the upper surface 24. However, such sound communication openings 44 could be formed in other ways. For example, holes or ducts (not illustrated) could be formed to extend between the upper surface 24 and the sound channeling voids 38.

Turning now to FIG. 3, the location of loud speaker 28 within pillow headrest 22 is illustrated. Because both loud speakers 28 and 30 are similarly and symmetrically disposed, only loud speaker 28 will be discussed in the following. It should be realized that in the preferred embodiment, each loud speaker is of a type that is commonly available: each loud speaker 28–30 is of the type of construction that employs a cone which vibrates responsive to electromagnetic signals. With this type of construction, sound waves are emitted in front of the loud speaker, i.e., its exterior face 32, as well as to the rear through its rear face 34.

As can be seen, a portion of loud speaker 28 is disposed below the upper surface 24 into the lower body portion 26. For this purpose loud speaker cavity 50 is provided to receive loud speaker 28. To maintain loud speaker 28 in proper position, any ordinary adhesive could be employed to affix loud speaker 28 to the pillow headrest 22 within loud speaker cavity 50. Also illustrated in FIG. 3 is a common two conductor wire 52 that provides a connection between the loud speaker 28 and a electronic music source such as a common transistor radio 56 as seen in FIG. 5.

Importantly, a loud speaker 28 disposed as noted above will produce sound waves that project rearward in to the pillow headrest 22 as well as outward toward the user's head. In this way, sound from the loud speakers is directed toward and into the sound channeling voids 38 wherein the sound waves travel through the sound channeling voids 38 and through the communication openings to reach the user's head. In this way, sound waves reach the user's head from multiple directions. Accordingly, the quality of sound that eventually is heard by the user is enhanced.

Figure 5:
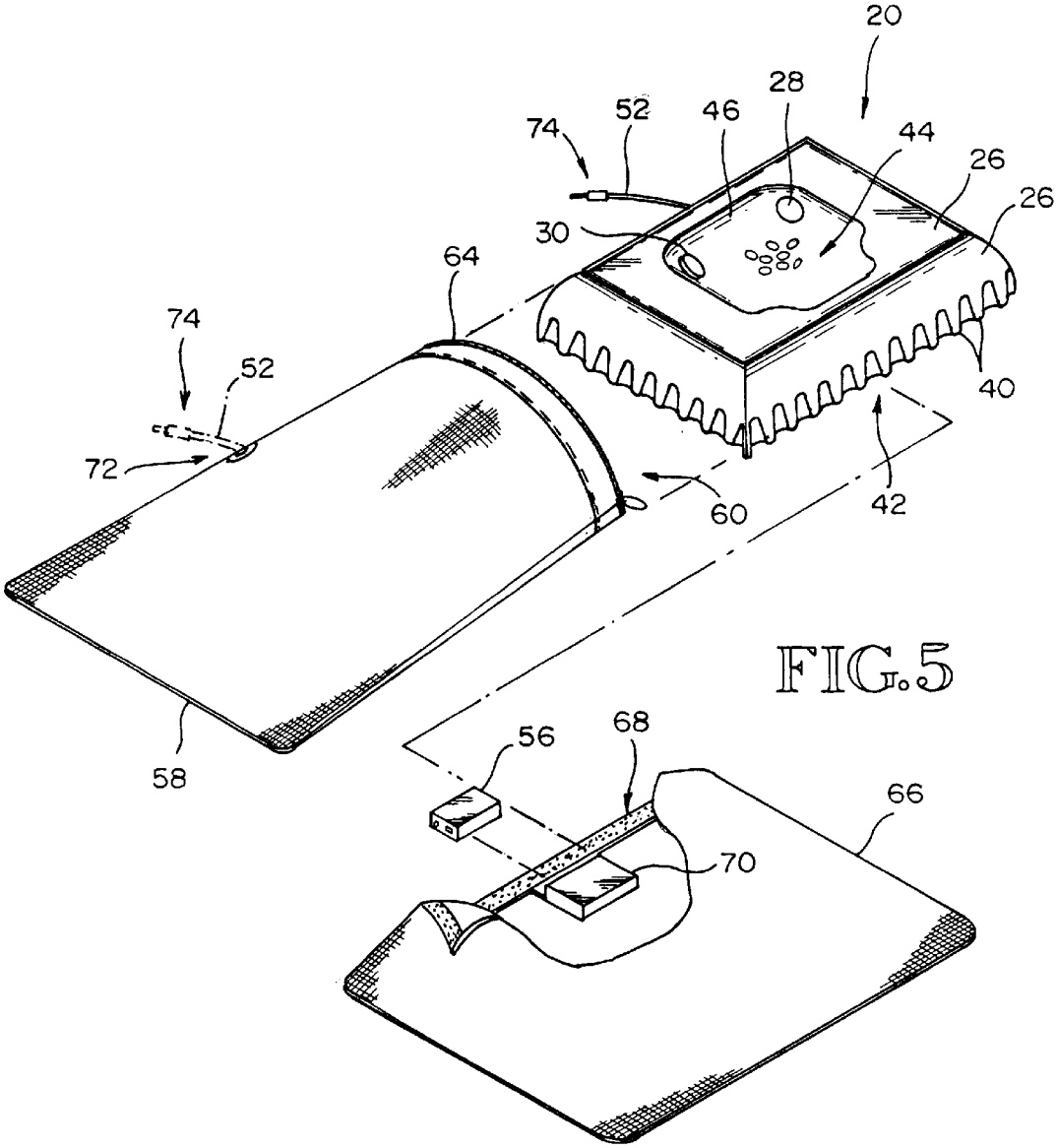
FIG. 5 is a front side perspective view of a speaker pillow constructed in accordance with the present invention illustrating two pillow cases; one pillow case having a zippered end through which the speaker pillow is received, and the other pillow case having a Velcro® closure along a top edge including a pocket disposed for receiving a portable radio.

Directing attention to FIG. 5, a pillow case 58 is illustrated. The pillow case 58 includes an opening 60 encircled by a zipper 64. Accordingly, a pillow speaker 20 can be received into pillow case 58 for protection wherein zipper 64 can be employed to totally enclose the pillow speaker 20. Also provided is a reinforced opening 72 so that the wire leads from the loud speakers 28 and 30 can be directed therethrough for connection with a electrically energized music source, i.e., radio 56. For this purpose a jack 74 is illustrated at the end of wire 52. Further, it should be noted that the reinforced opening 72 could be constructed using any commonly available plastic or metal grommet.

As an alternate, pillow case 66 is provided with an upper edge 68 fastened with a typical hook and loop fastener, i.e. Velcro®. As illustrated in FIG. 5, pillow case 66 includes a pocket 70 sewed to a interior portion of the pillow cast 66, disposed close to the upper edge 68, for receiving and supporting a common portable transistor radio 56. With this configuration, the pillow speaker 20 is portable for ease of use.

The construction and method for making a pillow speaker 20 is straight forward and uncomplicated. First, a pillow headrest 22 is formed from a homogeneous flexible material such as foam. Such forming techniques are well known in the industry and will therefore not be discussed here. The pillow headrest 22 includes an upper surface 24 for receiving and supporting a person's head, and a lower body portion 26 that extends downward from the upper surface 24, adapted for support from an exterior stable surface. A pair of loud speakers 28–30 are mounted through the upper surface 24, within the lower body portion 26. Importantly, the loud speakers 28–30 are spaced apart: each loud speaker including an exterior face 32 for projecting sound outward from the pillow speaker 20, and an opposing rear face 34 for projecting sound into the lower body portion 26. Essentially, the lower body portion of the pillow speaker is formed to comprise a plurality of large sound channeling voids 38 through which sound waves from the loud speakers can travel.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

What is claimed is:

1. A pillow speaker for use as a combination headrest and sound delivery system for delivering and transmitting sounds generated by an electronic source, including music to a person's head, the pillow speaker comprising:

a pillow headrest having an upper surface for receiving and supporting a person's head, and a lower body portion that extends downward from the upper surface, wherein the lower body portion is adapted for support from an exterior stable surface, the pillow headrest being constructed from a homogeneous flexible material;

a pair of spaced apart loud speakers adapted for connection to an electronic source, the loud speakers being mounted through the upper surface, within the lower body portion, the loud speakers having an exterior face for projecting sound outward from the pillow speaker, and an opposing rear face for projecting sound into the lower body portion; and wherein the lower body portion of the pillow speaker is arranged to define a plurality of sound channeling voids through which sound waves from the loud speakers can travel.

2. A pillow speaker as recited in claim 1 wherein the sound channeling voids are interconnected to define a plurality of sound baffles, the sound baffles being integral with the lower body portion and projecting downward in relation to the upper surface.

3. A pillow speaker as recited in claim 2 wherein the sound baffles are formed in the shape of cones.

4. A pillow speaker as recited in claim 3 wherein the sound baffles are symmetrically disposed.

5. A pillow speaker as recited in claim 1 further comprising a plurality of sound communication openings that extend from the upper surface through the lower body portion to the sound channeling voids.

6. A pillow speaker as recited in claim 5 wherein the upper surface is formed to define a head receiving cavity.

7. A pillow speaker as recited in claim 6 wherein the sound communication openings extend to the head receiving cavity, and the loud speakers are disposed within the head receiving cavity.

8. A pillow speaker for use as a combination headrest and sound delivery system for delivering and transmitting sounds generated by an electronic source, including music to a person's head, the pillow speaker comprising:

a pillow headrest having an upper surface for receiving and supporting a person's head, and a lower body portion that extends downward from the upper surface, wherein the lower body portion is adapted for support from an exterior stable surface, the pillow headrest being constructed from a homogeneous flexible material;

a pair of spaced apart loud speakers adapted for connection to an electronic source, the loud speakers being mounted through the upper surface, within the lower body portion, the loud speakers having an exterior face for projecting sound outward from the pillow speaker, and an opposing rear face for projecting sound into the lower body portion;

a plurality of sound baffles defined by the lower body portion, the sound baffles projecting downward in relation to the upper surface.

9. A pillow speaker as recited in claim 8 further comprising a plurality of sound communication openings that extend from the upper surface through the lower body portion to the sound baffles.

10. A pillow speaker as recited in claim 8 wherein the upper surface is formed to define a head receiving cavity.

11. A pillow speaker as recited in claim 10 wherein the head receiving cavity extends downward to the sound baffles such that sound communication openings are formed on the upper surface to facilitate communication of sound from the sound baffles to the upper surface.

12. A pillow speaker as recited in claim 8 wherein the sound baffles are formed in the shape of cones.

13. A method for making pillow speaker for use as a combination headrest and sound delivery system for delivering sounds generated from an electronic source, including music to a person's head, the method comprising the steps:

forming a pillow headrest from a homogeneous flexible material, the pillow headrest having an upper surface for receiving and supporting a person's head, and a lower body portion that extends downward from the upper surface, wherein the lower body portion is adapted for support from an exterior stable surface;

mounting a pair of loud speakers through the upper surface, within the lower body portion, the loud speakers being spaced apart and having an exterior face for projecting sound outward from the pillow speaker, and an opposing rear face for projecting sound into the lower body portion; and forming the lower body portion to define a plurality of sound baffles, the sound baffles projecting downward in relation to the upper surface.

14. A method for making a pillow speaker as recited in claim 13 further comprising the step of forming communication openings that extend from the upper surface through the lower body portion to the sound baffles.

15. A pillow speaker as recited in claim 14 further comprising the step of forming the upper surface to define a head receiving cavity.

* * * * *